US007819228B2

(12) United States Patent
Terry et al.

(10) Patent No.: US 7,819,228 B2
(45) Date of Patent: Oct. 26, 2010

(54) COLLISON PREVENTION IN HOISTWAY WITH TWO ELEVATOR CARS

(75) Inventors: Harold Terry, Avon, CT (US); Greg Schienda, Plantsville, CT (US); Frank Sansevero, Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 597 days.

(21) Appl. No.: 11/816,318

(22) PCT Filed: Feb. 17, 2005

(86) PCT No.: PCT/US2005/005057

§ 371 (c)(1),
(2), (4) Date: Aug. 15, 2007

(87) PCT Pub. No.: WO2006/088456

PCT Pub. Date: Aug. 24, 2006

(65) Prior Publication Data

US 2008/0142312 A1 Jun. 19, 2008

(51) Int. Cl.
*B66B 9/00* (2006.01)

(52) U.S. Cl. ..... 187/249; 187/388

(58) Field of Classification Search ..... 187/247, 187/249, 293, 296, 297, 380–388
See application file for complete search history.

(56) References Cited

U.S. PATENT DOCUMENTS

| | | | |
|---|---|---|---|
| 849,840 | A | 4/1907 | Foster |
| 974,439 | A | 11/1910 | Schwab |
| 1,027,628 | A | 5/1912 | Schwab |
| 1,805,227 | A | 5/1931 | Rugg |
| 1,896,776 | A | 2/1933 | James |
| 1,896,777 | A | 2/1933 | James |
| 5,663,538 | A | 9/1997 | Sakita |
| 5,823,299 | A | 10/1998 | Wierschke et al. |
| 5,865,274 | A | 2/1999 | Kiji et al. |
| 5,877,462 | A | 3/1999 | Chenais |
| 6,273,217 | B1 | 8/2001 | Hikita |
| 6,360,849 | B1 | 3/2002 | Hikita |

(Continued)

FOREIGN PATENT DOCUMENTS

| | | | |
|---|---|---|---|
| EP | 1371596 | A1 | 12/2003 |

(Continued)

*Primary Examiner*—Jonathan Salata
(74) *Attorney, Agent, or Firm*—Carlson, Gaskey & Olds PC

(57) ABSTRACT

An elevator system (8) includes a hoistway (9) having a plurality of cars (10, 11) traveling therein, the hoistway includes a steel tape (14), each car having two tape readers (20, 21; 22, 23) which feed corresponding position detectors (29, 30: 31, 32) to provide independent position signals (35, 26: 37, 38). A group controller (52) assigns calls in a fashion to avoid collisions. Controllers (45, 46) for each car communicate with each other and when deemed necessary, either lower the speed, acceleration, deceleration of one or both of the cars, or stop (with or without reversing) one or both of the cars. Independent processors (41, 42) will drop the brake (49, 50) of either or both cars if they come within a first distance of each other, or will engage the safeties (18, 19) of either or both cars if they come within a lesser distance of each other.

6 Claims, 5 Drawing Sheets

U.S. PATENT DOCUMENTS

| | | | | |
|---|---|---|---|---|
| 6,364,065 | B1 | 4/2002 | Hikita | |
| 6,554,107 | B2 | 4/2003 | Yumura et al. | |
| 7,032,716 | B2 | 4/2006 | Meyle et al. | |
| 7,117,979 | B2 | 10/2006 | Angst et al. | |
| 7,178,635 | B2 | 2/2007 | Meissner et al. | |
| 7,448,471 | B2 * | 11/2008 | Nuebling | 187/286 |
| 2005/0082121 | A1 | 4/2005 | Deplazes | |
| 2005/0087402 | A1 | 4/2005 | Haegi et al. | |
| 2005/0279584 | A1 | 12/2005 | Reuter et al. | |
| 2006/0289240 | A1 | 12/2006 | Sakita | |
| 2007/0039785 | A1 | 2/2007 | Smith et al. | |

FOREIGN PATENT DOCUMENTS

| | | | |
|---|---|---|---|
| EP | 1698580 | A1 | 9/2006 |
| JP | 4345486 | | 12/1992 |
| JP | 4361960 | | 12/1992 |
| JP | 5051185 | | 3/1993 |
| JP | 5132257 | | 5/1993 |
| JP | 6305648 | | 11/1994 |
| JP | 8133611 | | 5/1995 |
| JP | 7157243 | | 6/1995 |
| JP | 7172716 | | 7/1995 |
| JP | 8133630 | | 5/1996 |
| JP | 9110316 | | 4/1997 |
| JP | 2001226050 | | 8/2001 |
| JP | 2001240318 | | 9/2001 |
| JP | 2001247265 | | 9/2001 |
| JP | 2001251188 | | 9/2001 |
| JP | 2001335244 | | 12/2001 |
| JP | 2002220164 | | 8/2002 |
| JP | 2002255460 | | 9/2002 |
| JP | 2003160283 | | 6/2003 |
| JP | 2004155519 | | 6/2004 |

* cited by examiner

COLLISON PREVENTION IN HOISTWAY WITH TWO ELEVATOR CARS

TECHNICAL FIELD

This invention relates to avoiding collision of two elevator cars traveling in the same hoistway in several ways, including assigning cars so as to avoid collisions, responding to potential collisions by one or more of reducing speed, acceleration, deceleration, delaying start of a car, stopping a car at a non-assigned floor, or reversing one car to allow another car to reach its destination; independent collision avoidance will operate the brake of one or more cars or engage the safeties of one or more cars in impending collision situations.

BACKGROUND ART

To provide maximum service with minimal impact on useable space, it is known to provide more than one elevator car traveling independently within the same hoistway. In some systems, call assignments are extremely rudimentary so that there is no problem with potential collision of cars, but such systems do not add significant service since many calls cannot be assigned. Examples are illustrated in U.S. Pat. Nos. 5,419,414, 6,360,849 and U.S. Pat. No. 2003/0164267.

To maximize the benefit of having more than one car traveling in a single hoistway, additional controls are needed to assure the cars will not collide, while providing significant increases over the single-car service.

DISCLOSURE OF INVENTION

Objects of the invention include: provision of elevator service by more than one car traveling in a single hoistway without risk of collision between cars; and improved elevator service employing two cars traveling in the same hoistway.

According to the invention, calls requesting service from an entry floor to a destination floor are assigned to one of a plurality of cars operating in the same hoistway in a manner to avoid situations where collisions between the cars could occur.

In further accord with the invention, cars traveling in the same hoistway check the assignment of each new call to determine whether such call could create a potential collision situation, and request reassignment if a collision is possible.

In accordance with the invention further, cars traveling in the same hoistway exchange information and determine when potential collision situations are impending, and take steps to mitigate the chances of collision, such as; reducing speed, acceleration, or deceleration; stopping one or both cars; revenging one or both cars; or holding a car at a landing when it is stopped.

In still further accord with the present invention, impending collisions indicated by the cars being within a first distance of each other are avoided by one or both cars having brakes applied, and are avoided within a lesser distance by engaging the safeties of one or both cars.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
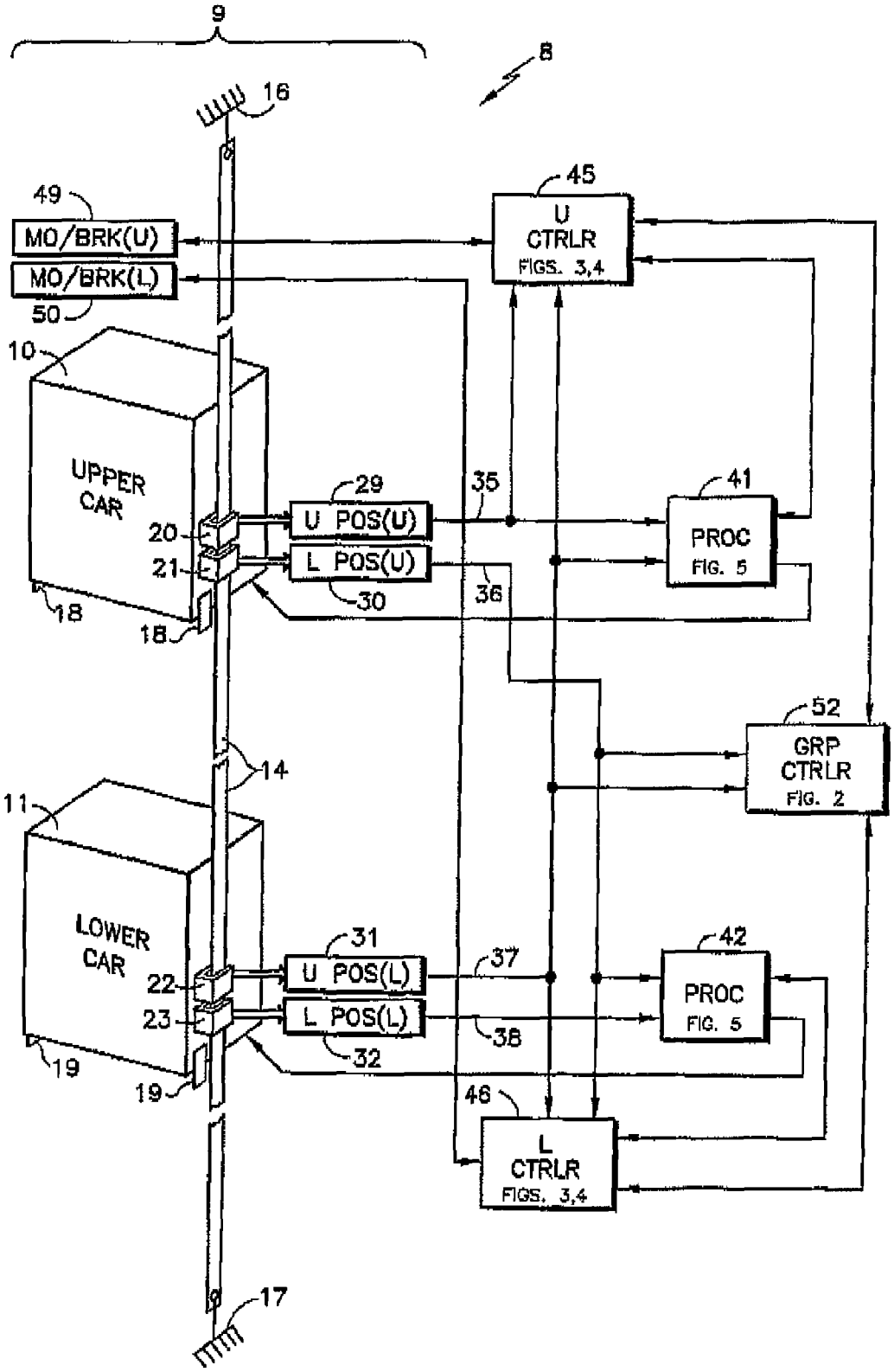
FIG. 1 is a partial perspective view of an elevator hoistway having a plurality of cars, with a simplified block diagram of the invention.

Referring to FIG. 1, an elevator system 8 having a hoistway 9 includes an upper car 10 and a lower car 11 both traveling within the hoistway 9. In the hoistway there is a durable steel encoded tape, such as a stainless steel tape 14 with code punched therein. The tape 14 extends between two fixed parts of the hoistway 16, 17. Each ear has conventional safeties 18, 19, which operate in a conventional fashion against both of the guide rails (not shown).

On each elevator car there are two tape readers, an upper (U) tape reader 20 and a lower (L) tape reader 21 on the upper car 10, and upper and lower tape readers 22, 23 on the lower car 11. Each of the tape readers and corresponding associated circuitry 29-32 provide information 35-38 of the position of the upper car and the lower car to redundant processors 41, 42 as well as to on upper car controller 45 and lower car controller 46. The processors 41, 42 may operate the brake of either car's motor/brake system 49, 50 or engage the safeties of the upper car and the lower car, whenever the cars are too close to each other, as described with respect to FIG. 5 hereinafter.

A group controller 52 assigns calls for service, as is described with respect to FIG. 2, hereinafter. In the embodiment herein, it is assumed that calls for service made on any floor include the destination which the caller wishes to reach. Therefore, in any consideration of the possibility for collision between the cars, both the pickup floor (where the call is entered), which is referred to herein as "F" and the destination floor, referred to here in as "D", must be taken into consideration. In the description herein, U generally refers to the upper car but may also refer, where it is apparent, to the position of the upper car. "L" generally refers to the lower car, but when the context is clearly so, it refers to the position of the lower car.

Figure 2:
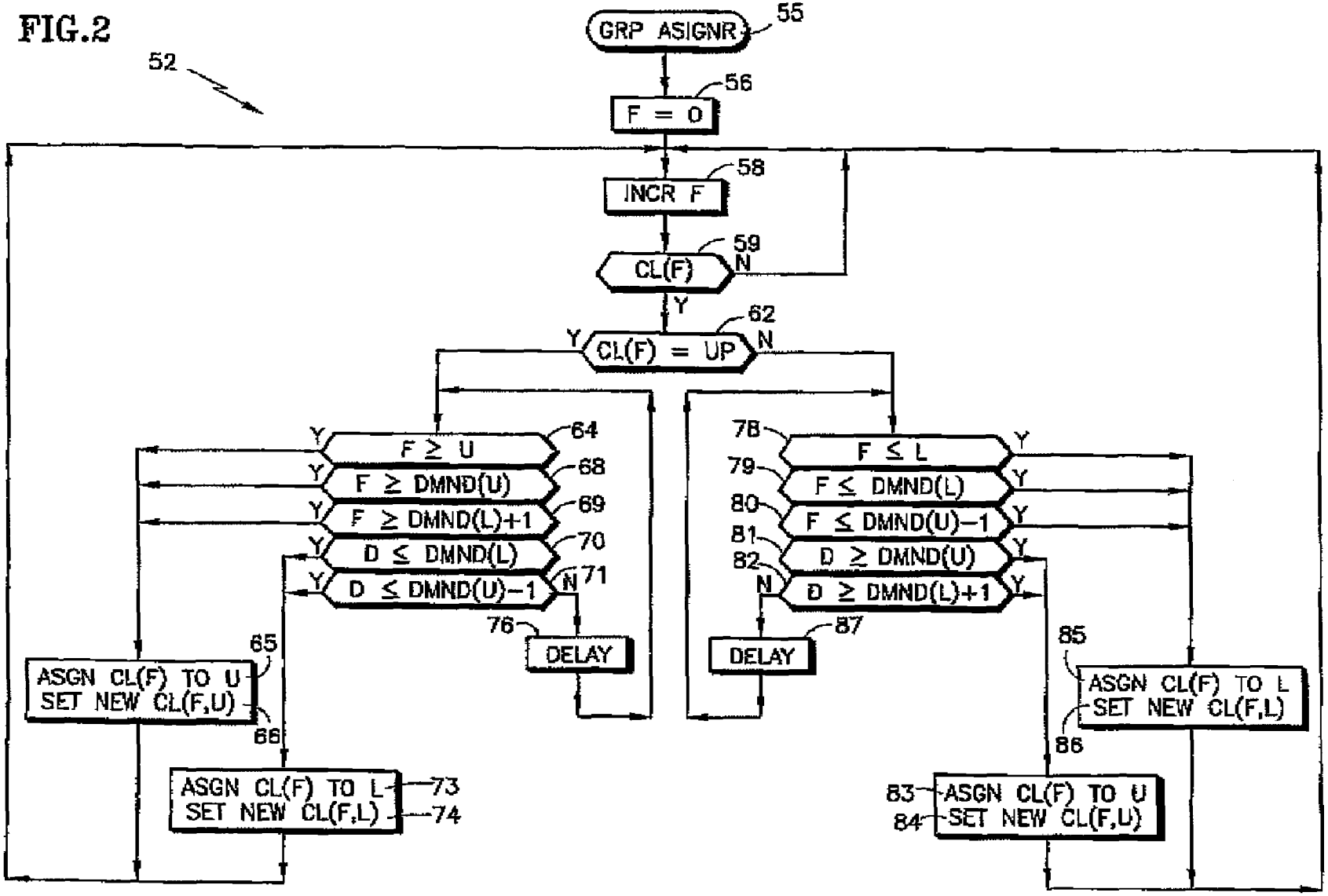
FIG. 2 is a flow chart illustrative of functions which may be performed in assigning elevator cars in accordance with the invention.

Referring to FIG. 2, functions that may be performed in order accommodate the operational strategy of the present invention with respect to the assignment of calls, which in this embodiment maybe accomplished by the group controller 52, are illustrated in FIG. 2. For example, a group assignor subroutine may be reached through an entry point 55, and a first step 56 resets a floor counter, F, to zero. Then a step 58 increments the floor counter and a test 59 determines if there is a call at the designated floor. If not, the step 58 increments F again and the test 59 is repeated, When there is a call on the designated floor, a test 62 determines if the call is in the up direction, or not. If the call is in the up direction, a test 64 determines if the floor is at or above the position of the upper car, U. If it is, when the call is in the up direction, there can be no problem by assigning the call to the upper car, which is achieved in a step 65. Then a step 66 will set a flag indicating there is a new call at floor F assigned to the upper car.

The routine then returns to the step 58 to increment the floor counter again and the test 59 to see if there is a call at the next floor in turn. If there is, the test 62 will again determine whether the call is in the up direction.

If the test 64 is negative, then a series of tests 68-71 will be reached unless any of the tests 68-70 are affirmative. The test 68 determines if the floor is equal to or higher than the demand in the upper car (that is, the highest stop that it is now scheduled to make). If so, the call will he assigned to the upper car. If not, a test 69 determines if the floor is at or higher than the demand in the lower car plus one floor. This indicates that the lower call will not be coming to the pickup floor, F, so the call may be assigned to the upper car. Or a test 70 will determine if the destination of the call, D, is at or below the demand for the lower car. If it is, the lower car will be traveling upward from the call floor, F, to or beyond the destination of the call and therefore the lower car may take the call, as is achieved by a step 73. Then a step 74 will set a flag to indicate that there is a new call at floor F for the lower car. A test 71 determines if the destination of the call is at or below demand of the upper car minus one floor, which indicates that the lower car can answer the call without coming closer than one floor to where the upper car may be at any time. In such case, the steps 73, 74 assign the call to the lower car.

If all of the tests 64, 68-71 are negative, in this particular embodiment, a delay step 76 is reached to allow conditions in the hoistway to change after which call assignment is again attempted by the questions 64, 68-71. If desired, a more sophisticated embodiment may be utilized in which the timing of the position of each car is taken into account; in that way, even though the demand of the two cars may overlap each other, the timing of reaching that demand may be sufficiently distant so as not to pose a collision problem. This may be accomplished in a variety of ways, the details of which are cumbersome, and not presented here for clarity.

Should a call be in the down direction, a negative result of test 62 reaches a series of tests 78-82 and steps 83-87 which are similar to those just described except for consideration of the downward direction from floor F to destination D.

In accordance with an aspect of the present invention, once the calls have been assigned, such as by the group controller, each of the car controllers 45, 46 communicate with each other to determine if the call has been properly assigned. That is, to determine if a likelihood of collision results from the new call assignment.

Figure 3:
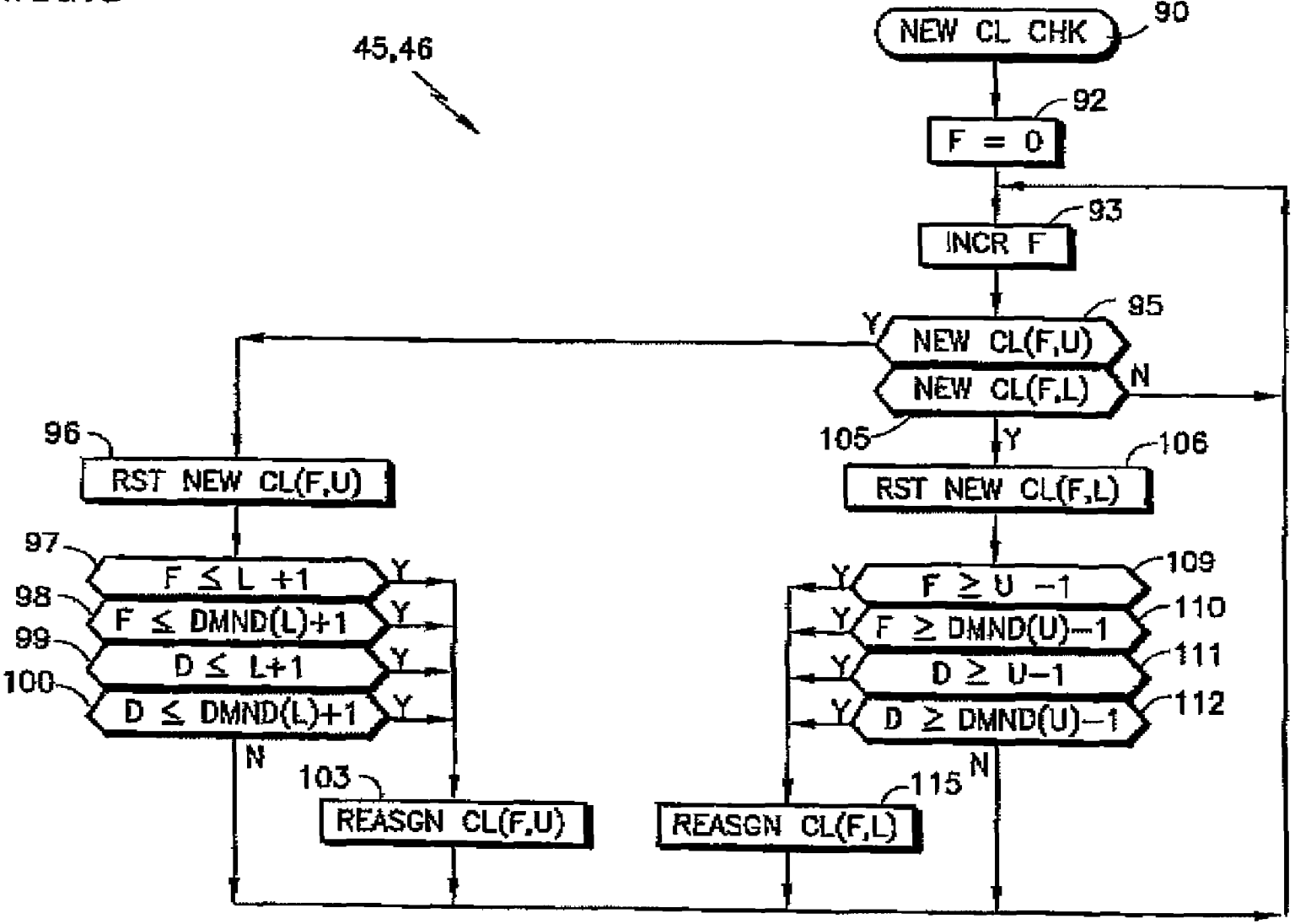
FIG. 3 is a flow chart illustrating checking of newly assigned calls to determine the potential for collision.

In FIG. 3, functions illustrating one example of achieving the operational strategy of the invention are presented as a program routine which may be performed in both of the car controllers 45,46 and reached through an entry point 90. A first step sets a floor counter, F, (different from that of FIG. 2) to zero. A step 93 increments F to point to a first floor. Then a test 95 determines if a flag has been set indicating a call from floor F newly assigned to the upper car. If so, a step 96 resets that flag and a series of tests 97-100 determine if either the floor of the call, F, or the destination of the call, D, is at or below one floor above either the lower car or the demand for the lower car. If any of those situations are true, an affirmative result of one of the tests 97-100 will reach a step 103 indicating that the call should be reassigned. If none of those conditions are true, then a negative result will cause the routine to revert to the step 93 to increment F and check the next floor to see if a new call flag has been set.

If the flag is not set for the upper car, a test 105 will determine if a flag has been set indicating mat a call at floor F has been newly assigned to the lower car. If so, a step 106 will reset that flag and a series of tests 109-112 will determine if either the floor, F, or the destination, D, is at or above one floor below the upper car. If any of those conditions exist, a step 115 will indicate that the call at floor F assigned to the lower car should be reassigned. If a call at floor F has not been newly assigned to either the upper or lower car, negative results of tests 95, 105 will cause the program to revert to step 93 to check calls on the next floor.

The determination of whether or not the calls have been correctly assigned may be made in a variety of ways, the functions illustrated in FIG. 3 being exemplary only. Particularly, if the strategy used for assigning the calls in the first place is more complex than that described with respect to FIG. 2, checking the appropriateness of assignments of new calls may be more complex than that illustrated in FIG. 3. However, such various embodiments are within the purview of the invention.

Figure 4A:
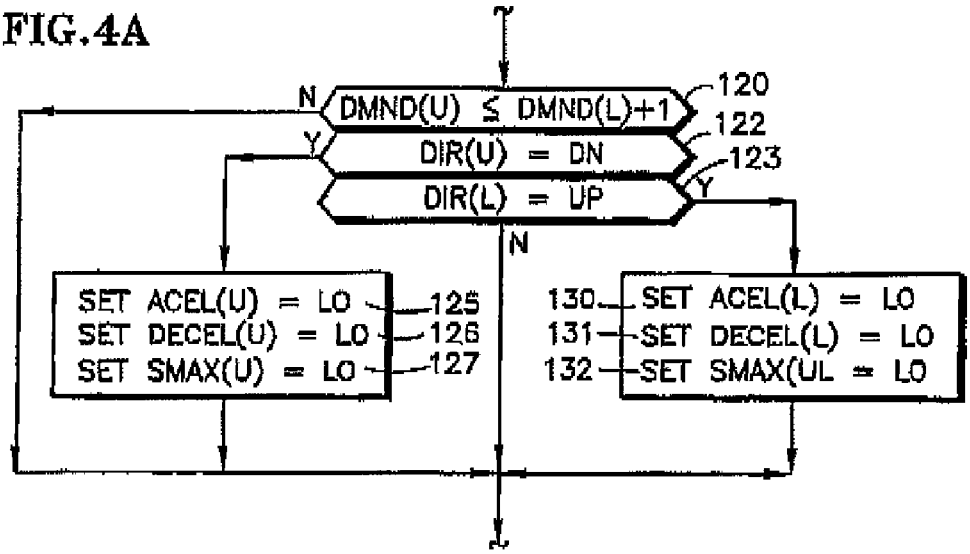
FIGS. 4A-4C are partial flow charts illustrating exemplary checking functions in accordance with the invention.
Figure 4B:
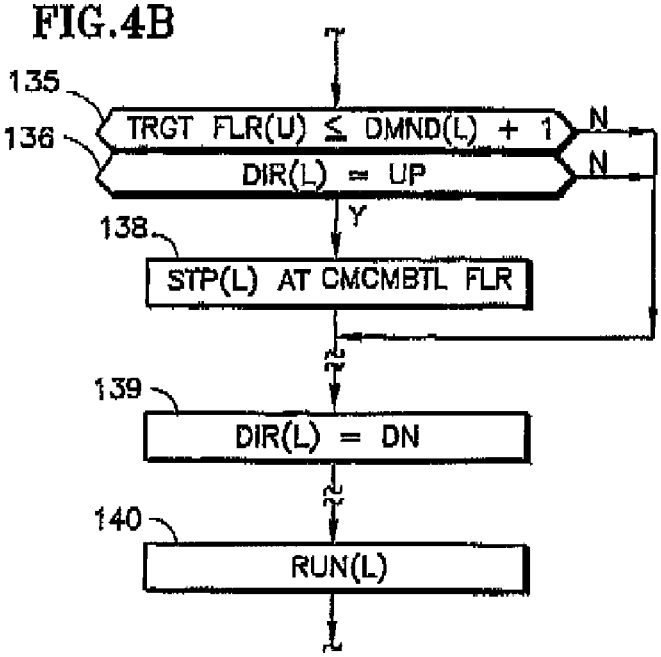
Figure 4C:
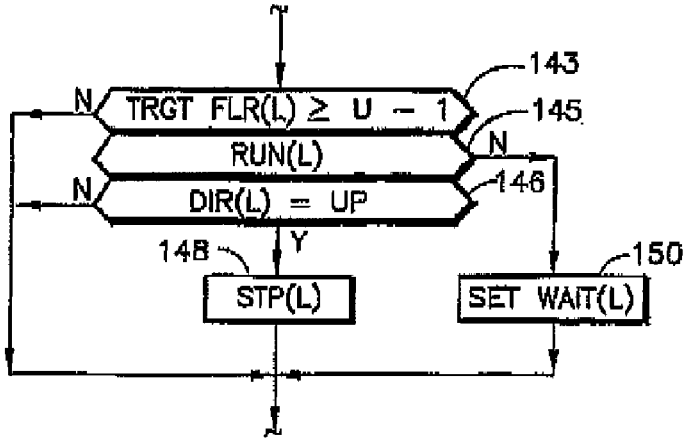

In addition to checking new call assignments, each of the controllers 45, 46 may continuously check for likelihood of collision between the two cars, some examples of which are illustrated in FIGS. 4A-4C. In FIG. 4A, a test 120 will determine if the demand for the upper car is at or below one floor above the demand for the lower car. If not, no further action is taken in FIG. 4A. But if test 120 is affirmative, then a pair of tests 122, 123 determine what to do. If the upper car is traveling down, as indicated in test 122, then a series of steps will set the acceleration, deceleration and maximum speed of the upper car to a low value. But if the upper car is not traveling down and the lower car is traveling up, then a series of stops 130-132 will set the acceleration, deceleration and maximum speed of the lower car to a low value. Similar functions may be performed in the event that the demand of the lower car is at or above one floor below the demand of the upper car, with comparative consequences.

In FIG. 4B, a test 135 determines if the target floor of the upper car is at or below one floor above the demand of the lower car. If so, a test 136 determines if the direction of the lower car is up; if so, a step 138 will cause the lower car to be stopped at its committable floor, under control of its motor. Then a step 139 will cause the direction of the lower car to be changed to down, and a step 140 will cause the lower car to run. The steps 138-140 comprise a reversal, and delays and other required steps in the process, which are conventional, have been omitted for clarify.

Tests and steps similar to those of FIG. 4B could be performed in response to test 135 by sensing that the direction of the upper car is down, and reversing it. Similar steps and tests could be performed by sensing that the target floor of the lower car is at or above one floor below the present position of the upper car, with comparable tests and steps as a consequence. The illustration in FIG. 4B is exemplary merely, and other tests may be performed which result in a reversal of one or both of the cars.

In FIG. 4C, a test 143 determines if the target floor of the lower car is at or above one floor below the upper car. If it is, a test 145 determines if the lower car is running. If it is running then a test 146 determines if it is running in the up direction. If so, the lower car may receive a stop command as a result of a step 148. If the lower car is not running, a negative result of test 145 will set a flag indicating that the lower car should wait. If it is running, a test 146 will cause a step 148 to stop the lower car if it is running up. This may be a normal (although unscheduled) stop, which is caused by deceleration of the motor, rather than the brake. If either test 143 or test 146 is negative, the lower car will not be stopped or caused to wait.

Functions other than those described with respect to FIG. 4C may be employed to test the likelihood of an impending collision, such as testing for other relationships, to stop one or both cars or cause a car to wait. Also, the cars may be controlled in other fashions in response to such tests.

FIGS. 4A-4C arc exemplary of tests and consequences of those tests which either or both controllers may perform in operations seeking to avoid collisions between the two cars. In FIGS. 3 and 4A-4C, the safe differential between the two cars is indicated as being two floors, such as in the test 97 in FIG. 3 which determines if the call floor, F, is equal to or below one floor above the position of the lower car. However, one, three, or more floors could be used as a differential, in which case the test would be whether F is at or below L+2, for instance.

Figure 5:
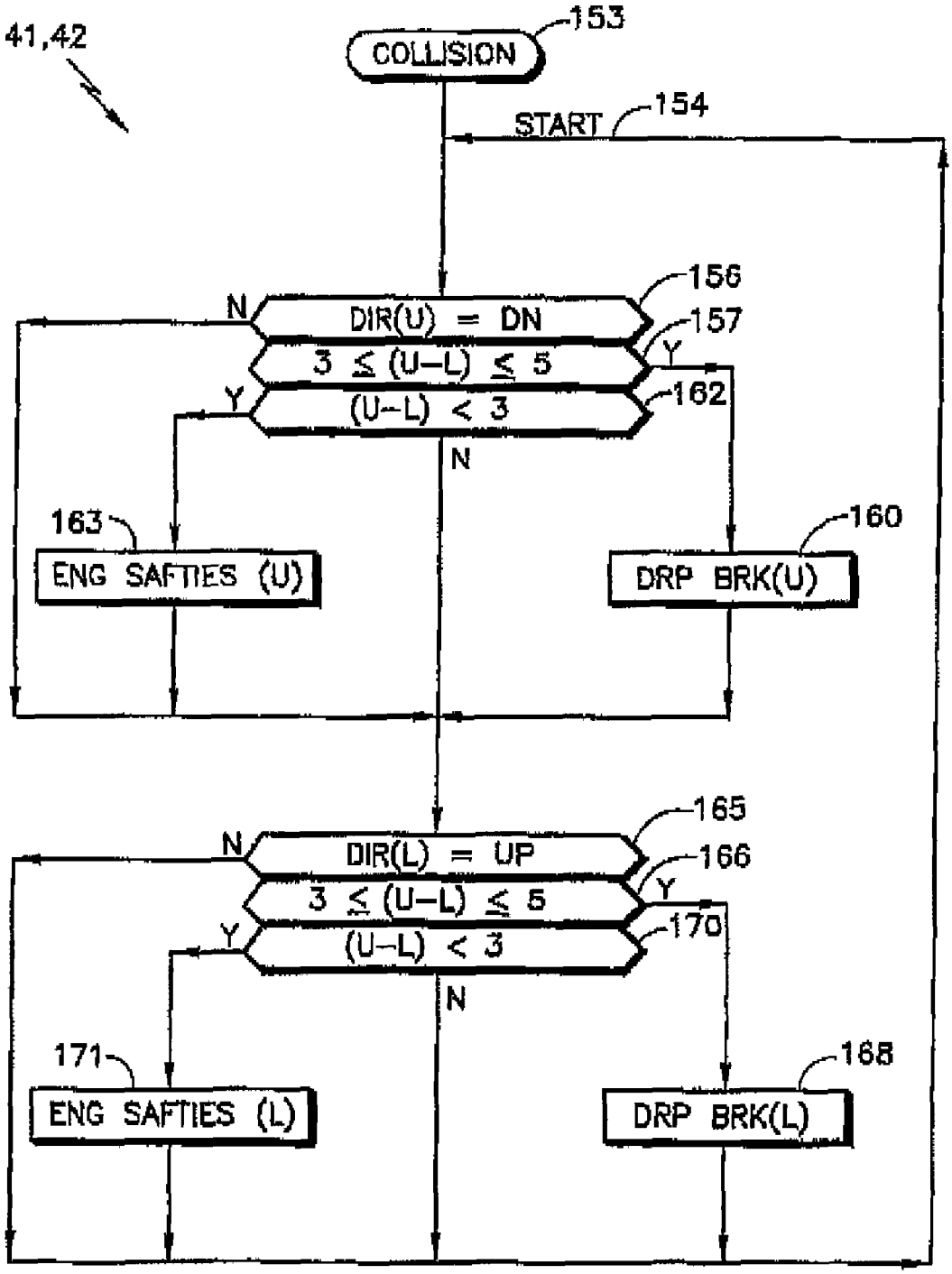
FIG. 5 is a flow chart illustrating tests and steps to avoid collisions between cars.

The processors 41, 42 of FIG. 1 provide an independent, redundant check for impending collisions and will either drop the brake or engage the safeties of one or more of the cars. In the example herein, functions which may be performed to carry out the operational strategy of the present invention are illustrated in FIG. 5 in the form of a program expressed in a flow chart. FIG. 5 represents programs which may be performed in both of the processors 41, 42, but is merely exemplary of conditions which may cause operation of the brakes or safeties of one or more of the cars.

In FIG. 5, a collision routine is reached through an entry point 153, and will thereafter proceed from a start state 154 through the remainder of the routine, repetitively, to continuously check for an imminent collision. A first test 156 determines if the direction of the upper car is down. If it is, a test 157 determines if the spacing between the cars is four floors. If so, a step 160 causes the brake 49 of the upper car to be dropped, thereby stopping the upper car. If the spacing of the cars is not four floors, then a test 162 determines if the spacing of the cars is less than three floors. If it is, a step 163 causes the safeties 18 of the upper car to be engaged. If the upper car is not going down, a negative result of the test 156 causes the steps and tests 157-163 to be bypassed.

In FIG. 5, a test 165 determines if the direction of the lower car is up. If so, a test 166 determines if the separations of the cars is four floors, and if it is, a step 168 will cause the brake 50 of the lower car to be dropped. Otherwise, a test 170 determines if the spacing between the cars is less than three floors, in which case a stop 171 will engage the safeties 19 of the lower car. If the direction of the lower car is not up, the tests and steps 166-171 are bypassed.

The form of tests, and the particular numbers used, as well as the general relationship between when the brakes may be dropped and when the safeties may be engaged, all may be selected to suit any implementation of the present invention.

The invention claimed is:

1. A method of operating an elevator system having a plurality of cars within a single hoistway, each having a controller, and in which calls for elevator service designate the desired destination floor, said method comprising:

assigning each call for service to one of said elevator cars in a manner which will assure that the elevator cars will not collide;

using the controller of each car for determining whether each assigned call will potentially result in a collision of the elevator cars; and reassigning any of the assigned calls determined to potentially result in collision of the elevator cars in the hoistway.

2. A method according to claim 1, wherein said assigning is performed in a group controller.

3. A method of operating an elevator system having a plurality of cars within a single hoistway, each having a controller, and in which calls for elevator service designate the desired destination floor, said method comprising:

assigning each call for service to one of said elevator cars in a manner which will assure that the elevator cars will not collide;

continuously determining whether there is a likelihood of collision between the elevator cars to determine whether an assigned call should be reassigned to a different one of said elevator cars; and mitigating the likelihood of collision by at least one of (a) reducing a maximum speed of at least one of said cars, (b) reducing an acceleration of at least one of said cars;

(c) reducing a deceleration of at least one of said cars;

(d) causing an unscheduled stop of at least one of said cars;

(e) causing at least one of said cars to wait at a stop; and (f) reversing a direction of motion of one of said cars.

4. A method according to claim 3, wherein said continuously determining is performed in each of said controllers.

5. A method of operating an elevator system having a plurality of cars within a single hoistway, each having a controller, and in which calls for elevator service designate the desired destination floor, said method comprising:

assigning each call for service to one of said elevator cars in a manner which will assure that the elevator cars will not collide;

determining whether an assigned call should be reassigned to a different one of the elevator cars based on a likelihood of collision between the elevator cars determined after the assigning;

continuously determining whether one of said cars is within a first distance of another one of said cars and responsively causing a brake of at least one of said cars to operate; and continuously determining whether one of said cars is within a second distance, smaller than said first distance, of another one of said cars and responsively causing a safety of at least one of said cars to be engaged.

6. A method according to claim 5, wherein said continuously determining is performed in each of two independent processors.

* * * * *